US005545061A

United States Patent [19]

Sawayanagi

[11] Patent Number: 5,545,061

[45] Date of Patent: Aug. 13, 1996

[54] PANEL LOCK CONNECTOR

[75] Inventor: Masahiro Sawayanagi, Shizuoka-ken, Japan

[73] Assignee: Yazaki Corporation, Tokyo, Japan

[21] Appl. No.: 294,864

[22] Filed: Aug. 29, 1994

[30] Foreign Application Priority Data

Aug. 30, 1993 [JP] Japan ..... 5-214390

[51] Int. Cl.[6] ..... H01R 13/514

[52] U.S. Cl. ..... 439/752; 439/556

[58] Field of Search ..... 439/752, 557, 439/552, 555, 556, 595

[56] References Cited

FOREIGN PATENT DOCUMENTS 55-44317 10/1980 Japan .
4-3413 2/1992 Japan .

*Primary Examiner*—Neil Abrams
*Assistant Examiner*—Barry Matthew L. Standig
*Attorney, Agent, or Firm*—Wigman, Cohen, Leitner & Myers, P.C.

[57] ABSTRACT

A panel lock connector includes a connector housing having chambers formed therein for accommodating electrical terminals and a spacer inserted into the connector housing in a direction perpendicular to a direction along which the terminals are inserted into the chamber. The connector housing is provided in a peripheral wall with an opening and flexible lock arms each of which has an engagement projection to be engaged with a hole formed in the panel. Under condition that the spacer is inserted into the opening and the connector housing is engaged into the panel incompletely, an axial end of the spacer is positioned close to the panel in comparison with the engagement projection. Under condition that the spacer is inserted into the connector housing incompletely, the top of the base projects from the peripheral wall. In such a case, a further insertion of the connector into the panel is restricted by an interference of the base of the spacer with the panel.

6 Claims, 5 Drawing Sheets

PANEL LOCK CONNECTOR

BACKGROUND OF THE INVENTION

The present invention relates to a connector to be fitted into a door panel or the like of an automobile, which will be referred to "a panel lock connector" hereinafter. More particularly, it relates to a panel lock connector capable of checking an incomplete insertion of electrical terminals into the connector and an incomplete attachment of a spacer for supporting the terminals by detecting whether flexible lock arms provided in the connector fit into the door panel or not.

In Japanese Examined Utility Model Publication (Kokoku) No.4-3413, there is disclosed a conventional panel lock connector comprising a connector housing which is made of synthetic resinous material and which includes flexible lock arms formed integrally therewith. In the connector, the flexible lock arms are formed on the upside, downside, left side and right side of a peripheral wall of the connector housing, respectively. In the connector, by fitting the connector housing in a hole formed in a door panel of an automobile or the like, projections formed on the flexible lock arms can be engaged with the hole. Consequently, the connector is fixed in the door panel, so that a so-called panel locking operation can be completed.

Accommodated in the connector housing are a plurality of electrical terminals of which rear portions are held by a synthetic resinous spacer which is inserted into the connector housing. The spacer serves to prevent the terminals from falling out of the connector housing. In assembly, a rubber water-resistant grommet is fitted to the rear end of the connector housing in order to lock the connector in the door panel. Furthermore, in this arrangement, since a front lip of the grommet clings on the door panel, it is possible to prevent the water from intruding into the connector.

In the above mentioned arrangement, however, even in a case that any one of the terminals is not inserted into the connector housing completely, the connector would be locked in the panel even if the spacer engages with the terminals incompletely. Therefore, it is impossible for an operator to determine from outside of the grommet whether the cause of trouble is derived from the incomplete insertion of the terminals into the connector housing or it is derived from the incomplete attachment of the spacer.

Furthermore, if electrical wires connected to the terminals are subject to high tensile strength under condition that the connector is assembled in the panel, the spacer is lifted by the terminals, whereby the former is disengaged from the connector housing.

SUMMARY OF THE INVENTION

It is therefore an object of the present invention to provide a panel lock connector which allows an operator to detect an incomplete insertion of terminals into a connector housing and an incomplete insertion of a spacer into the connector housing even when a water resistant grommet is attached on the connector.

Furthermore, it is an additional object of the invention to provide a panel lock connector which is capable of preventing the spacer from disengaging from the connector housing under condition that the connector is fitted into in a panel of an automobile or the like.

The objects of the invention described above can be accomplished by a panel lock connector fitted into a hole formed in a panel, the connector comprising:

a connector housing having chambers formed therein for accommodating electrical terminals, the connector housing being provided in a peripheral wall thereof with an opening and flexible lock arms each of which has an engagement projection to be engaged with the hole; and a spacer inserted into the connector housing through the opening in a direction perpendicular to a direction along which the terminals are inserted into the chambers to thereby support predetermined portions of the inserted terminals, the spacer having a base;

wherein, under condition that the spacer is inserted into the opening and the connector housing is fitted into the panel incompletely, an axial end of the spacer is positioned close to the panel in comparison with the engagement projection;

wherein, under condition that the spacer is inserted into the connector housing completely, a top of the base is arranged within the peripheral wall of the connector housing;

wherein, under condition that the spacer is inserted into the connector housing incompletely, the top of the base projects from the peripheral wall.

In the present invention, if the spacer is inserted into the connector housing incompletely, the spacer projects from the peripheral wall of the connector housing. In such a case, a further insertion of the connector into the panel is restricted by an interference of the base of the spacer with the panel. Therefore, it is possible to prevent the terminals and the spacer from being inserted into the connector housing incompletely.

Preferably, the spacer is also provided with a flexible lock arm which has an engagement projection to be engaged with the hole.

With the arrangement mentioned above, under condition that the connector is fitted into the panel, it is possible to present the spacer from disengaging from the connector housing.

Other objects and features of the present invention will become more fully apparent from the following description and appended claims taken in conjunction with the accompanying drawings.

DESCRIPTION OF THE PREFERRED EMBODIMENT

Figure 1:
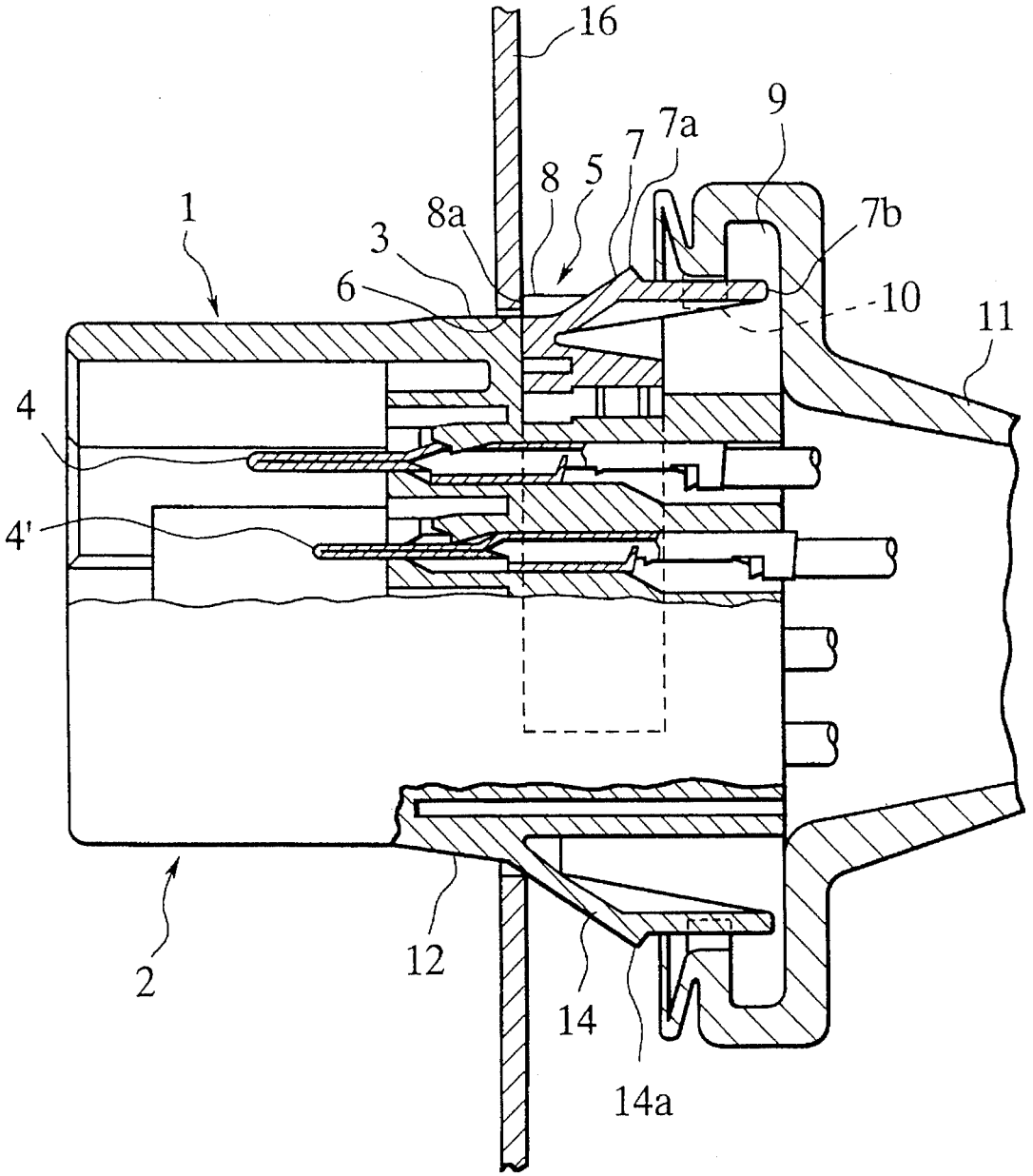
FIG. 1 is a longitudinal cross sectional view showing a panel lock connector in accordance with a first embodiment of the present invention, under condition that a spacer is attached to the connector incompletely.

An embodiment of the present invention is now described with reference to the drawings.

FIGS. 1 to 8 show a panel lock connectors 1 in accordance with the embodiment of the present invention. The connector 1 includes a connector housing 2 having elongated chambers into which electrical terminals 4 are inserted. The connector housing 2, which may be made of synthetic resinous material, is provided on peripheral wall portions 12 and 18 thereof with flexible lock arms 14 and 15, respectively. The lock arms 14 and 15 have projections 14*a* and 15*a* to be fitted into a hole 6 formed in a panel 16, respectively.

The connector 1 further includes a spacer S for supporting the terminals 4 inserted into the connector housing 2 completely. In assembly, through an opening 24 formed in an upper peripheral wall portion 3 of the connector housing 2, the spacer 5 is inserted into the connector housing 2 in a direction perpendicular to the inserting direction of the terminals 4 into the housing 2.

Figure 4:
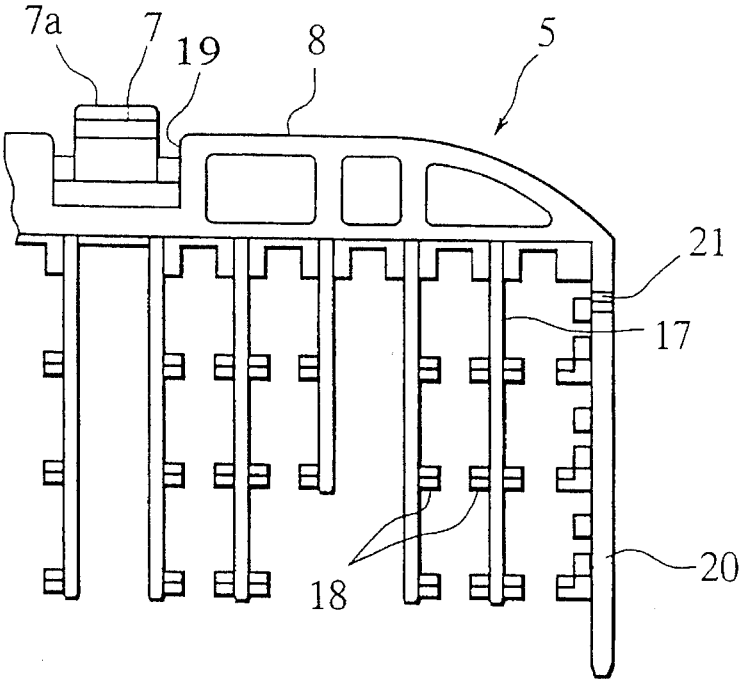
FIG. 4 is a rear view of the spacer of FIG. 3.

As shown in FIG. 4, the spacer 5 includes a flexible lock arm 7 for engaging with the panel 16 and a base 8. The base 8 has a plurality of legs 17 which extends downward therefrom to support the terminals 4. As shown in FIG. 1, the opening 24 is so formed in the connector housing 2 that, on condition that the spacer 5 is inserted into the opening 24 and the connector housing 2 is fitted into the panel 16 incompletely (FIG. 1), an axially front end 8*a* of the spacer 5 is positioned close to the panel 16 In comparison with the projections 14*a* and 15*a* of the connector housing 2.

The flexible lock arm 7 of the spacer 5 has a projection 7*a* which is arranged at a substantially intermediate position of the lock arm 7 in the longitudinal direction, and a free end 7*b* which protrudes rearward and horizontally from the projection 7*a*.

The connector housing 2 is provided at a rear end thereof with a flange 9 to which a water resistant grommet 11 of rubber is attached. The grommet 11 has a groove 10 into which the lock arm 7 is inserted.

Figure 2:
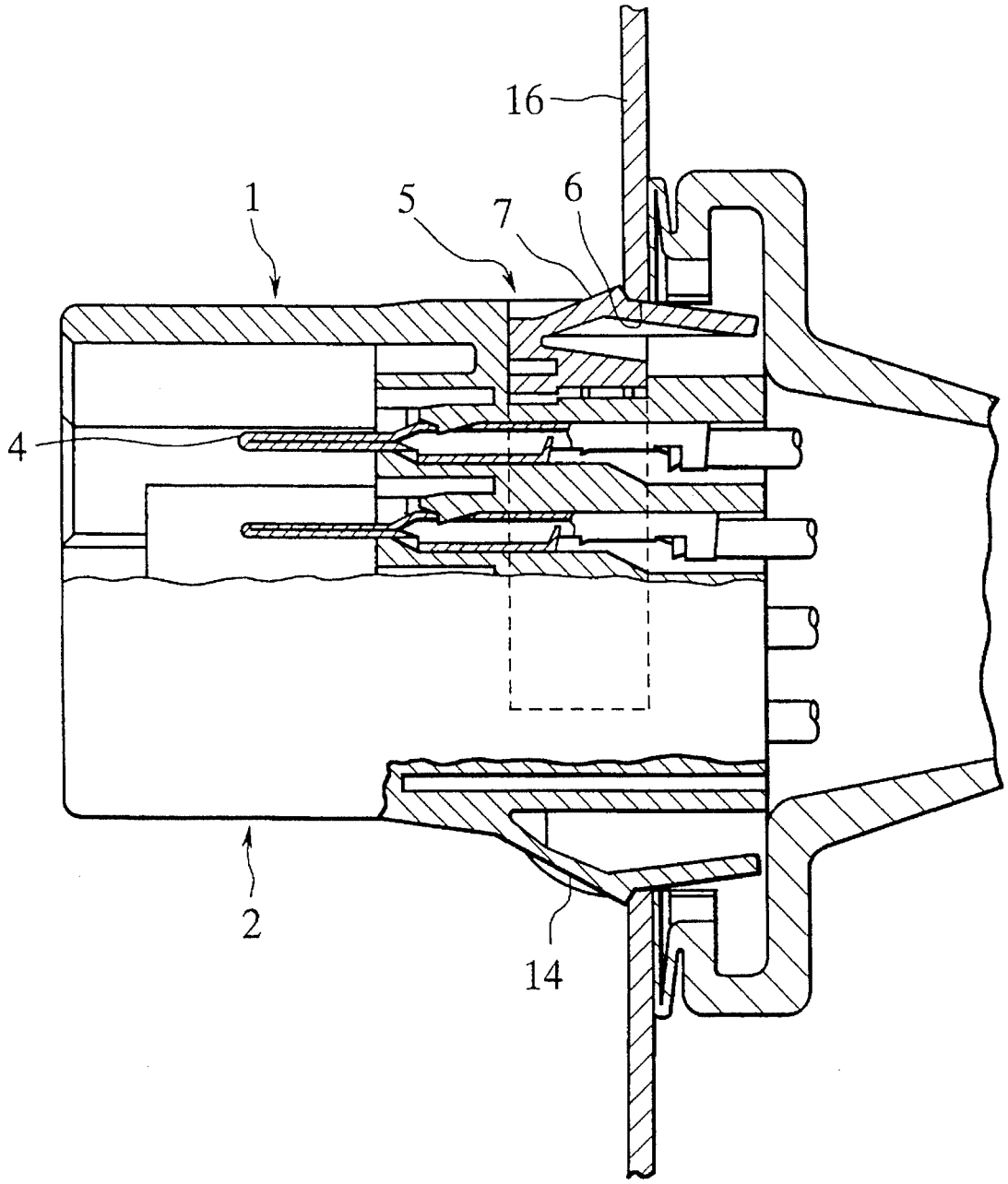
FIG. 2 is a longitudinal cross sectional view showing the panel lock connector of FIG. 1, under condition that the spacer is attached to the connector completely.
Figure 3:
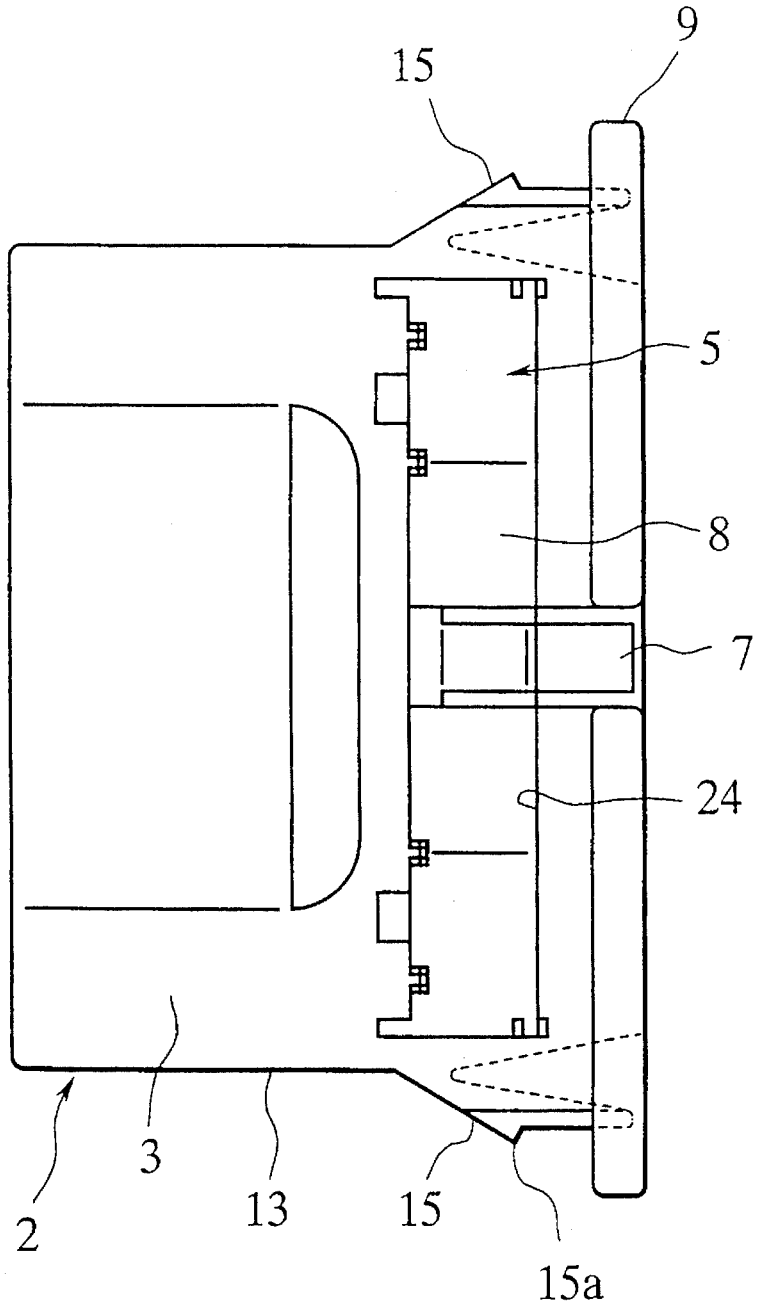
FIG. 3 is a top view showing a connector housing equipped with the spacer of FIG. 2.

The flexible lock arm 14, which is formed in the lower peripheral wall portion 12 of the connector housing 2, and the other flexible lock arms 15, which are formed in the left and right peripheral wall portions 13 (FIG. 3), respectively, are fitted in the hole 6 of the panel 16, together with the lock arm 7 of the spacer 5, as shown in FIG. 2. Therefore, FIG. 1 shows an Incomplete assembled condition in which the spacer 5 cannot be inserted into the connector housing 2 completely since the front end 8*a* of the spacer 5 interferes with the panel 16 because of incomplete insertion of the terminals 4 into the connector housing 2.

Figure 5:
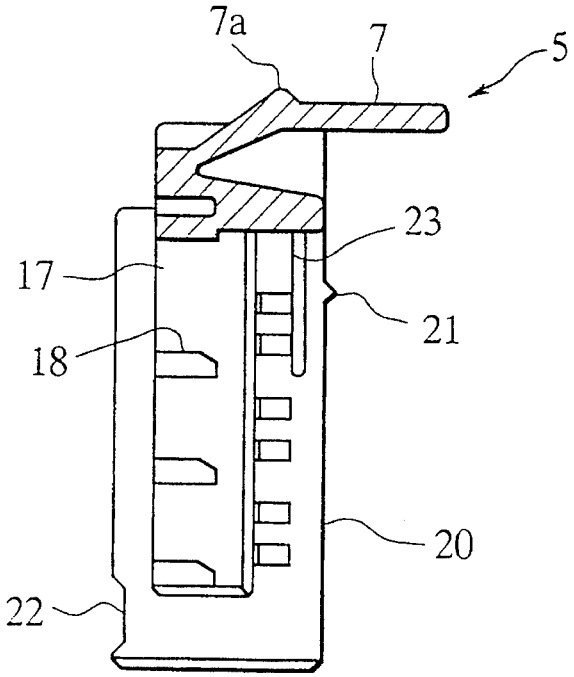
FIG. 5 is a cross sectional view of the spacer of FIG. 3.

As shown in FIGS. 4 and 5, the legs 17 like teeth of a comb are provided with projections 18 which face to each other. Each pair of the projections 18 are shaped in such a manner that, under condition that each terminal 4 is inserted into the connector housing 2 completely, the projections 18 support a specified portion (ex. a rear portion) of the terminals 4. Further, the flexible lock arm 7 having the projection 7*a* extending upward is formed in a recess 19 provided at the center of the base 8. Under condition that the spacer 5 is inserted perfectly, the base 8 thereof is arranged in alignment with the upper wall 3 of the connector housing 2; otherwise the base 8 is positioned lower than the upper wall 3. As shown in FIG. 5, each engagement plate 20 on each side of the spacer 5 is formed to have a width larger than that of the leg 17. The engagement plate 20 has a regular engagement projection 21 formed at a rear end thereof for engaging with the connector housing 2 and a temporary engagement groove 23 formed at a front end of the plate 20. Owing to provision of a temporary engagement groove 23, the projection 21 can bend to and fro.

Figure 6:
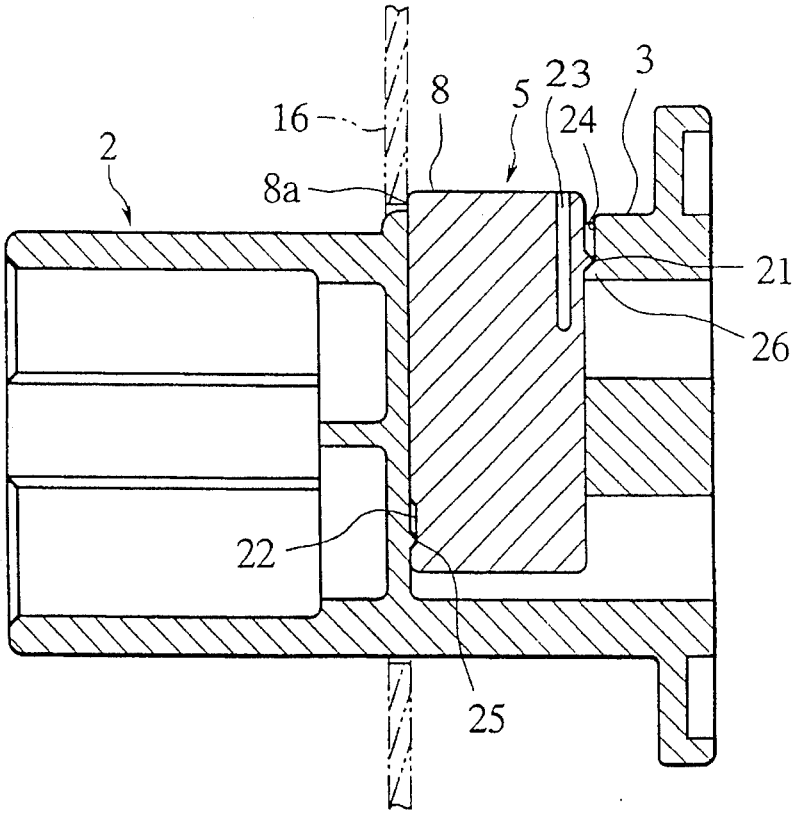
FIG. 6 is a longitudinal cross sectional view showing the connector housing to which the spacer is attached temporarily.
Figure 7:
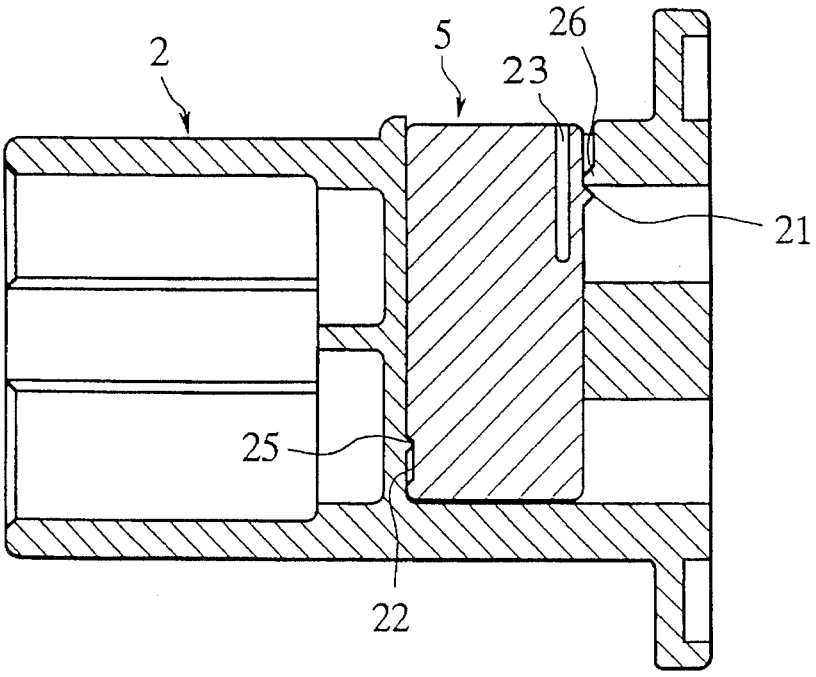
FIG. 7 is a longitudinal cross sectional view showing the connector housing to which the spacer is attached regularly.

In assembly, as shown in FIG. 6, the spacer 5 is inserted into the connecter housing 2 through the opening 24 in the upper wall 3 so as to engage the temporary engagement groove 23 with a temorary engagement projection 25 while the projection 21 is in contact with a projection 26 formed in the opening 24. Under such a temporarily engaged condition, a top of the base 8 of the spacer 5 projects from the upper wall 3 of the connector housing 2, so that the front end 8a of the base 8 interferes with the panel 16. Consequently, it is impossible to assemble the connector 1 to the panel 16, in a manner similar to the above-mentioned incomplete insertion of the terminals 4.

In a subsequent step, the spacer 5 is further depressed to attain the complete engagement thereof with the connector housing 2. Consequently, while the projection 25 thereof slides in the groove 22 of the spacer 5, the regular engagement projection 21 of the spacer 5 can engage with the projection 26 in the opening 24, after climbing over it. In this state, the projections 18 of the spacer 5 are brought into engagement with the rear parts of the terminals 4, whereby it is possible to prevent them from coming out of the connector 1. As mentioned above, when the spacer 5 is inserted into the connector housing 2 incompletely or any one of the terminals 4 is inserted incompletely, the top of the spacer 5 interferes with the panel, so that the connector housing cannot be assembled into the panel 16. Consequently, it is possible to detect the incomplete insertion of terminals 4 into the connector housing 2 and the incomplete attachment of spacer 5 to the connector housing 2 even when a water resistant grommet 11 is attached to the connector 1.

In addition, according to the invention, since the spacer 5 is also provided with the flexible lock arm 7 having the engagement projection 7*a* to be engaged with the hole 6, it is possible to present the spacer 5 from disengaging from the connector housing 2 under condition that the connector 1 is fitted into the panel 16.

Finally, it will be understood by those skilled in the art that the foregoing is a description of the preferred embodiment of the disclosed structure, and that various changes and modifications may be made to the present invention without departing from the spirit and scope thereof.

What is claimed is:

1. A panel lock connector fitted into a hole formed in a panel, said connector comprising:

a connector housing having chambers formed therein for accommodating electrical terminals, said connector housing being provided in a peripheral wall thereof with an opening and flexible lock arms, each said flexible lock arm having an engagement projection to be engaged with said hole; and a spacer inserted into said connector housing through said opening in a direction perpendicular to a direction along which said terminals are inserted into said chambers to thereby support predetermined portions of said inserted terminals, said spacer having a base;

wherein, under condition that said spacer is inserted into said opening and said connector housing is fitted into said panel incompletely, an axial end of said spacer is positioned close to said panel in comparison with said engagement projection;

wherein, under condition that said spacer is inserted into said connector housing completely, a top of said base is arranged within said peripheral wall of said connector housing; and wherein, under condition that said spacer is inserted into said connector housing incompletely, said top of said base projects from said peripheral wall and such incomplete insertion of said spacer prevents said connector from being fitted completely into said hole in said panel.

2. A panel lock connector as claimed in claim 1, wherein said spacer is provided with a flexible lock arm which has an engagement projection to be engaged with said hole.

3. A panel lock connector as claimed in claim 2, wherein said spacer has supporting means for supporting predetermined parts of said terminals inserted into said chambers, and wherein, on condition that said predetermined parts of said terminals are supported by said supporting means, said spacer is inserted into said connector housing completely.

4. A panel lock connector as claimed in claim 3, wherein said supporting means comprises a plurality of legs extending downward from said base and projections formed on said legs.

5. A panel lock connector as claimed in claim 4, wherein said spacer has engaging means for engaging said spacer with said connector housing.

6. A panel lock connector as claimed in claim 5, wherein said engaging means comprises a projection and a groove.

* * * * *